US005289703A

United States Patent [19]

Hiyashi et al.

[11] Patent Number: 5,289,703

[45] Date of Patent: Mar. 1, 1994

[54] DRUM TYPE WASHING MACHINE

[75] Inventors: Shoichi Hiyashi; Hidetoshi Ishihara, both of Nagoya, Japan

[73] Assignee: Mitsubishi Jukogyo Kabushiki Kaisha, Tokyo, Japan

[21] Appl. No.: 911,370

[22] Filed: Jul. 13, 1992

Related U.S. Application Data

[63] Continuation of Ser. No. 535,514, Jun. 8, 1990, abandoned.

[30] Foreign Application Priority Data

Jun. 16, 1989 [JP] Japan ..... 1-153696

[51] Int. Cl.[5] ..... D06F 37/06

[52] U.S. Cl. ..... 68/24; 68/142

[58] Field of Search ..... 366/220, 228, 233, 234; 68/24, 142, 143, 58

[56] References Cited

U.S. PATENT DOCUMENTS

| | | | |
|---|---|---|---|
| 119,859 | 10/1871 | Lee | 68/142 |
| 241,063 | 5/1881 | Posten | 68/142 |
| 1,038,468 | 9/1912 | White | 68/142 |
| 1,172,744 | 2/1916 | Sessions | 68/142 |
| 1,247,798 | 11/1917 | Dohn . | |
| 1,301,055 | 4/1919 | Humberger . | |
| 1,641,780 | 9/1927 | Parker . | |
| 1,847,159 | 3/1932 | Adams . | |
| 2,330,421 | 9/1943 | Haberstump . | |
| 2,406,494 | 8/1946 | Ferris . | |
| 2,580,435 | 1/1952 | Kirby . | |
| 2,637,514 | 5/1953 | O'Connor | 68/23.1 |
| 2,908,086 | 10/1959 | Fuhring . | |
| 2,995,918 | 8/1961 | Neidenthal | 68/23.1 |
| 3,116,243 | 12/1963 | Khan et al. . | |
| 3,116,626 | 1/1964 | Moschetti et al. . | |
| 3,302,433 | 2/1967 | Nallinger . | |
| 3,304,751 | 2/1967 | Schwing . | |
| 3,358,301 | 12/1967 | Candor . | |
| 3,369,985 | 2/1968 | Aubin | 366/234 X |
| 3,387,310 | 6/1968 | Marshall . | |
| 3,387,385 | 6/1968 | Mandarino, Jr. et al. . | |
| 3,444,710 | 5/1969 | Gauler et al. . | |
| 3,509,742 | 5/1970 | Baue | 68/23.1 |
| 3,524,263 | 8/1970 | Odle, Jr. et al. . | |
| 3,546,903 | 12/1970 | Hertig . | |
| 4,207,638 | 6/1980 | Biesinger et al. . | |
| 4,285,219 | 8/1981 | Grunewald . | |
| 4,756,623 | 7/1988 | Bishop | 366/228 X |

FOREIGN PATENT DOCUMENTS

| | | | |
|---|---|---|---|
| 383626 | 7/1987 | Austria . | |
| 677929 | 3/1965 | Belgium . | |
| 0343096 | 11/1989 | European Pat. Off. . | |
| 54165 | 10/1890 | Fed. Rep. of Germany . | |
| 829159 | 12/1951 | Fed. Rep. of Germany . | |
| 890037 | 9/1953 | Fed. Rep. of Germany . | |
| 2513660 | 10/1975 | Fed. Rep. of Germany . | |
| 2633604 | 2/1978 | Fed. Rep. of Germany | 68/23.2 |
| 3728361 | 3/1989 | Fed. Rep. of Germany . | |
| 1113123 | 11/1955 | France . | |
| 1370320 | 7/1964 | France . | |
| 183815 | 4/1923 | United Kingdom . | |
| 467594 | 6/1937 | United Kingdom . | |
| 858182 | 8/1958 | United Kingdom . | |
| 2095705 | 10/1982 | United Kingdom . | |

*Primary Examiner*—Frankie L. Stinson

[57] ABSTRACT

The drum type washing machine of the present invention is equipped with a drum that is rotated around a horizontal axis of rotation where the drum is formed by an outer wall with a form obtained by mutually joining the large-diameter parts of two truncated cones with substantially the same form. A plurality of beaters are installed on the inner surface of the peripheral wall of the drum with a predetermined spacing in the circumferential direction of the drum, arranged centripetally along the peripheral wall extending over the entire length of the drum in the direction of the rotary shaft.

4 Claims, 4 Drawing Sheets

DRUM TYPE WASHING MACHINE

This application is a continuation, of application Ser. No. 07/535,514 filed on Jun. 8, 1990, now abandoned.

FIELD OF THE INVENTION AND RELATED ART STATEMENT

The present invention relates to a centrifugal dehydrator in, for example, a dehydrating (washing) tank in a household washing machine, a washer for business, a dry cleaner and the like, or to various kinds of household and industrial laundry machines having a rotary drum tank adapted for a fully automatic washing, dehydrating and drying machine that performs washing, dehydration and drying in the same tank.

An example of the conventional drum type washing machine is shown in FIG. 4 and FIG. 5.

FIG. 4 is a vertical sectional view containing the axis of rotation of the drum, and FIG. 5 is a sectional along the line V—V in FIG. 4.

In the figures, 1 is a control part for controlling the operation of the washing machine, 2 is a dial for operating the control part, 3 is a cover opened and closed for inserting and taking out the laundry, 4 is an outer case and 5 is a rotary drum that constitutes the washing and dehydrating tank. In the peripheral wall 5*a* of the drum 5 there are provided numerous dehydrator holes 11 for separating water at the time of dehydration. In addition, a plurality of lifters 9, 10, 29 and 30, each having extremely different heights at its ends in the axial direction of the drum 5 with the central part of the drum as the boundary, and formed by connecting these end points with a curve, that are arranged with their orientations changed alternately. Reference numeral 8 shows an outer tank constituting the washing tank which has on its bottom part a drain pipe 13, a drain valve 18, and further, a motor 12 and a speed changer 26. Further, the rotary drum 5 is fitted to the outer tank 8 with the shafts 19 and 27 projecting from the center of the rear and the front end walls 5*b* and 5*c*, respectively, via the bearings 21 and 28. The drum 5 is rotated by receiving the rotation of the speed changer 26 via a pulley 15 provided on the front side shaft 27, a belt 17 and a pulley 16. In FIG. 5, is a suspension rod 6 for supporting the outer tank 8, 7 is a spring and 20 is a leg attached to the bottom surface of the outer case 4.

The washing operation of the drum type washing machine with the above construction can be described as in the following.

Namely, in the washing period, water is fed from a feed water electromagnetic valve or the like that is not shown to the outer tank 8 and to the interior of the drum 5. The supply of water is stopped when the water level reaches a predetermined level by detecting it with a pressure sensor that is not shown, and at the same time the rotary drum 5 is rotated by energizing the motor 12.

In this case, since the height of the lifters 9, 10, 29 and 30 varies conspicuously as one moves along the direction of the shaft, and the direction of the height change is set to be opposite alternately, the reshuffling, bending and stretching, and rubbing actions of clothes are enhanced in addition to the impact action due the falling of the clothes as a result of conspicuous action of the difference in the strengths of lifting the clothes. Accordingly, the cleaning power of the machine is enhanced markedly compared with the existing general drum type washing machine.

However, the washing machine described above that is equipped with the lifters that have an extreme difference along the shaft direction of the rotary drum has problems.

Namely, while the above-mentioned washing machine has the merit of turning over the laundry within the drum back and forth with respect to the shaft direction of the drum, the laundry tends to be distributed unevenly with respect to the center of gravity of the drum. Thus there is a shortcoming in that the vibrations of the drum due to the imbalance becomes excessive during the washing, especially during the dehydration process where the rotational speed of the drum is great. For this reason, in the above-mentioned washing machine the rotary drum is supported by the inboard style in order to reduce the bearing load, with no success in reducing the vibrations of the drum main body. Moreover, when the drum is inboard supported as in this machine, it becomes necessary to insert and remove the laundry from above through a narrow opening, which obstructs the operability markedly.

OBJECT AND SUMMARY OF THE INVENTION

Accordingly, it is the object of the present invention to provide a drum type washing machine which facilitates the reshuffling of the laundry within the drum, yet is easy to distribute the laundry well balanced with respect to the center of gravity of the drum, and is excellent in operability.

In order to achieve the above object, in a drum type washing machine in which a rotary drum with numerous water-passing holes on its peripheral wall is installed within an outer tank, and the washing, dehydration and drying of the laundry within the drum are carried out individually or continuously while driving the drum to rotate, the present invention has a drum formed by an outer wall in the form obtained by mutually joining two substantially equal shaped truncated cones at their large-diameter portions (form of an abacus bead), having a rotary shaft that is held substantially horizontally at the center of one end wall of the drum, and the rotary drum is equipped on the inner surface of its peripheral wall with a plurality of platelike beaters that are arranged centripetally with a predetermined spacing in the circumferential direction, extending along the peripheral wall over the entire length of the drum.

The laundry within the drum is lifted upward by the beaters at time of rotation of the drum in the washing process and collected due to the trough shape of beater form to the central part of the drum where the laundry falls off. Since the laundry incessantly changes its front and back sides in this manner within the drum, it becomes possible to obtain a high cleaning power.

On the other hand, the drum is given the so-called abacus bead form and is set so as to have its center located near the central part of the elastic support, so that it always holds the laundry at a position close to its center of gravity. Accordingly, it is possible to reduce the imbalance in the distribution of the laundry and suppress the generation of vibrations even at the time of high-speed rotation of the drum. Moreover, since the drum can by design be supported in cantilever fashion, it becomes possible to provide an opening for easy bringing in and taking out of the laundry in the front panel of the washing machine, thereby enhancing the operability of the machine.

DETAILED DESCRIPTION OF THE PREFERRED EMBODIMENTS

Figure 1:
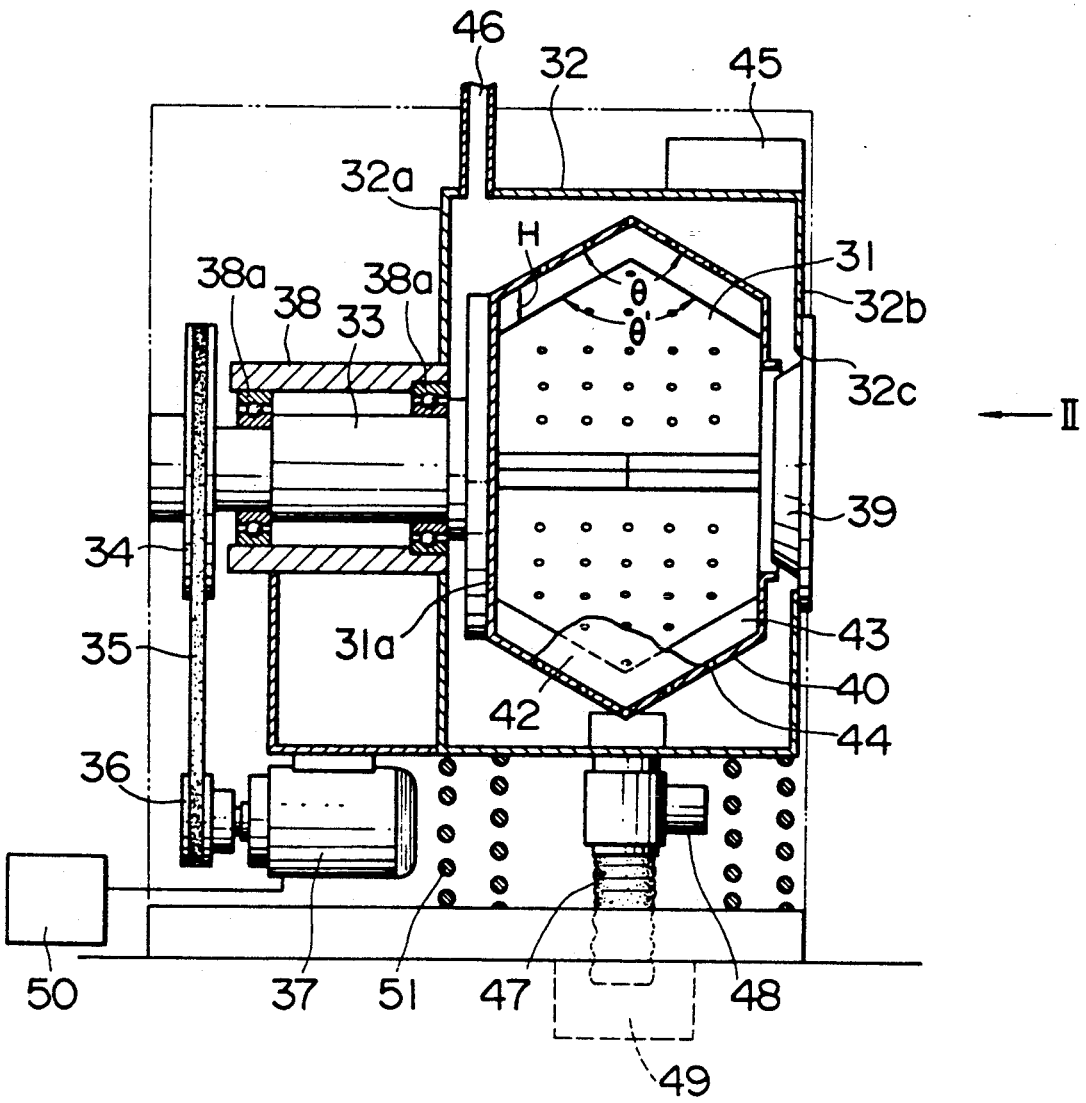
FIG. 1 is a vertical sectional view showing an embodiment of the drum type washing and dehydrating machine in accordance with the present invention.
Figure 2:
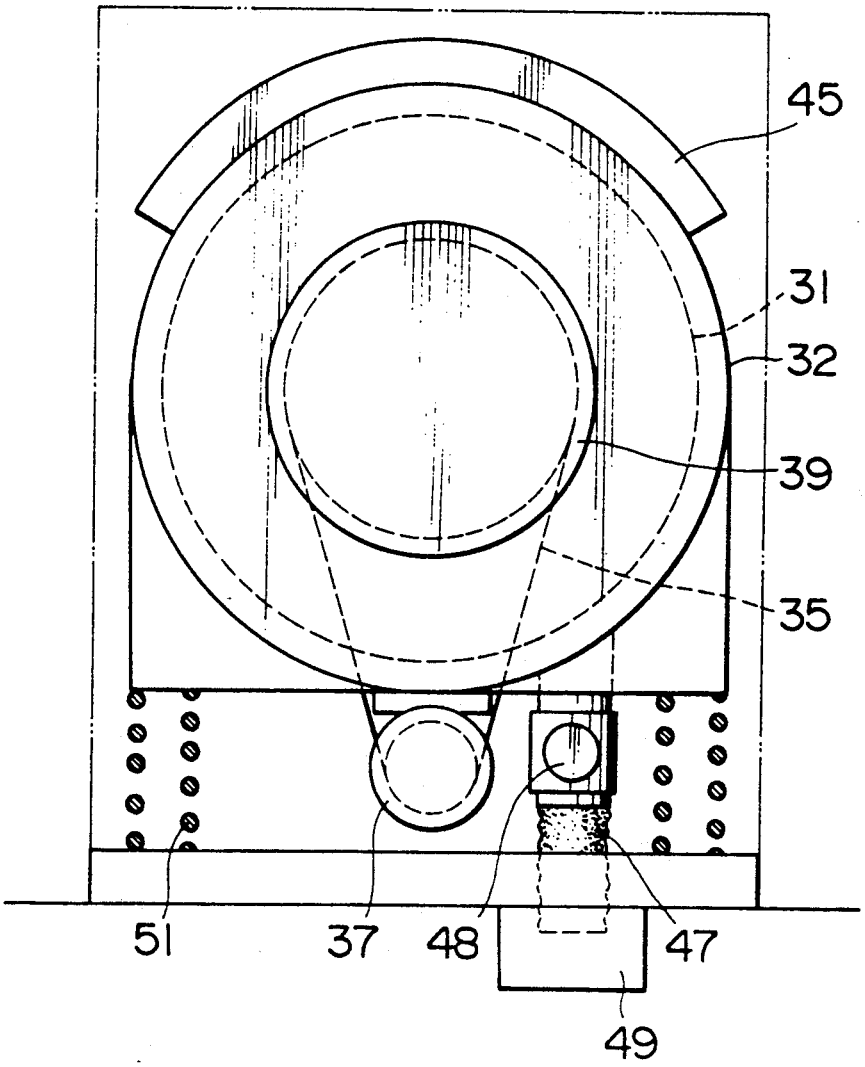
FIG. 2 is a front view of the machine in FIG. 1 as seen from the direction of the arrow II in FIG. 1.

Referring to the accompanying drawings, the embodiments of the invention will be described in detail in the following. FIG. 1 is a vertical sectional view of the typical embodiment of the drum type washing machine in accordance with the present invention. FIG. 2 is a front view of the washing machine of FIG. 1. As is clear from these figures, the form of the drum in accordance with the present embodiment is circular for a perpendicular cross-section at any point of the rotary shaft, and in a cross-section containing the axis of rotation, the peripheral wall of the drum and the axis of rotation of the drum form a predetermined angle.

More specifically about its overall construction, 31 in the figure is the rotary drum whose outer form is just like that of an abacus bead obtained by mutually joining the large-diameter portions of two truncated cones. The drum 31 has a rotary shaft 33 on its rear surface (left side of FIG. 1) 31*a*, and is supported in cantilever style by a drum support 38 via a bearing 38*a* while keeping the shaft 33 substantially horizontally. A pulley 34 is fixed to the rotary shaft 33, and the rotary shaft 33 and hence the drum 31 also are driven to rotate via a transmission path a driving V belt 35 and a driving pulley 36 fixed to the motor 37. On the peripheral wall 40 of the drum 31, there are provided numerous vent and water passing holes 44.

Reference numeral 32 is an outer tank arranged so as to enclose the drum 31, having the drum support 38 for supporting the drum rotary shaft 33 on its rear wall 32*a*. Outer tank 32 has fixed at a part a blowing part (omitted from the figure) for supplying water, steam, hot air and the like. In addition, an opening 32*c* is formed on the front wall 32*b* of the outer tank 32 for supplying and removing the laundry into and from the interior of the drum 31, and a door 39 is attached to the opening 32*c*.

The motor 37 which is the power source for driving the drum 31 as in the above, is installed in the lower part of the outer tank 32, and its rotation speed is appropriately set by means of the speed varying device 50.

Reference numeral 40 is the peripheral wall of the drum 31 in which are provided a multitude of holes 44 of diameter of about several millimeters for letting water pass through. The cross section of the peripheral wall 40 in the direction perpendicular to the rotary shaft is circular. Wall 40 has a ridge form of angle 8 with its central part projected outward with respect to the shaft direction.

Reference numeral 42 is the laundry (items to be washed) which consists of fabric products such as sheets, towels, shirts and the like that is to be washed and dehydrated.

Reference numeral 43 is a beater consisting of a plate, and a plurality of them are installed on the inner surface of the peripheral wall 40 of the drum 31 arranged centripetally extending in the direction of the rotary shaft, acting to lift the laundry 42 upward as the drum 31 rotates. The beater 43 which constitutes a component of the present invention has the form as shown in FIG. 1, namely, has a predetermined height H from the inner surface of the peripheral wall 40, and has the form of a trough with angle $\theta'$ which is equal to or greater than the angle $\theta$ of the peripheral wall 40 when seen from the interior of the drum.

Figure 3A:
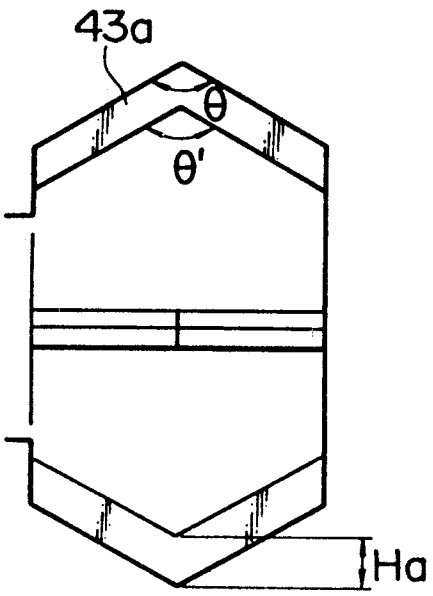
FIGS. 3(*a*)-3(*c*) illustrate the form of the inventive beater of the rotary drum in comparison to other beaters.
Figure 3B:
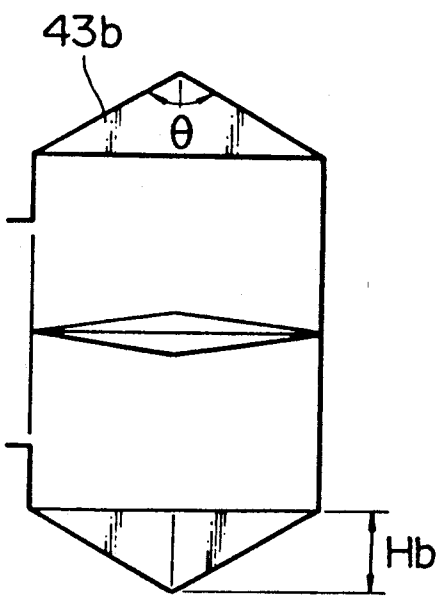
Figure 3C:
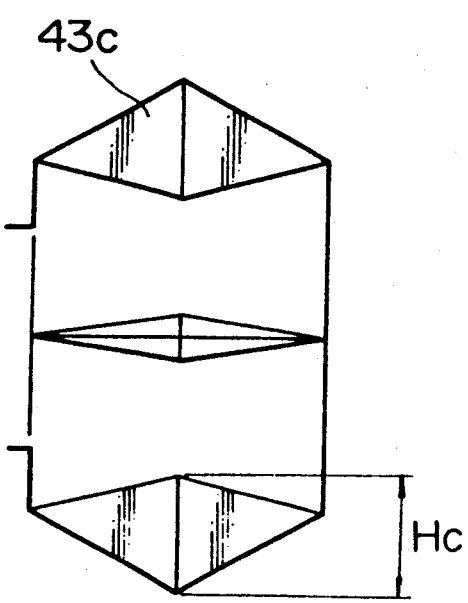
Figure 5:
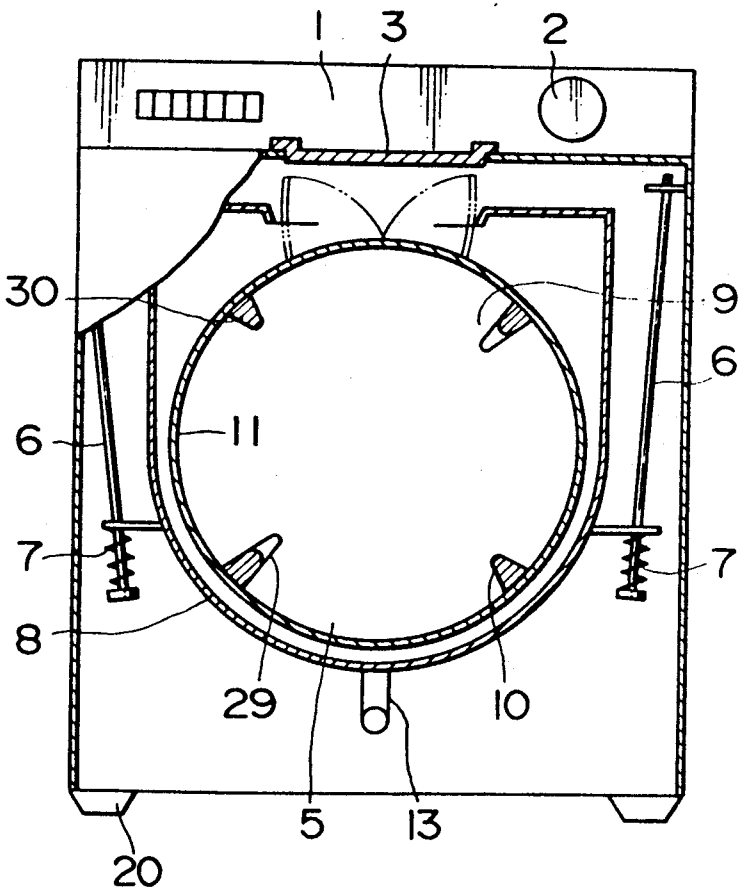
FIG. 5 is a vertical sectional view of the machine in FIG. 4 containing the line V—V in FIG. 4.
Figure 4:
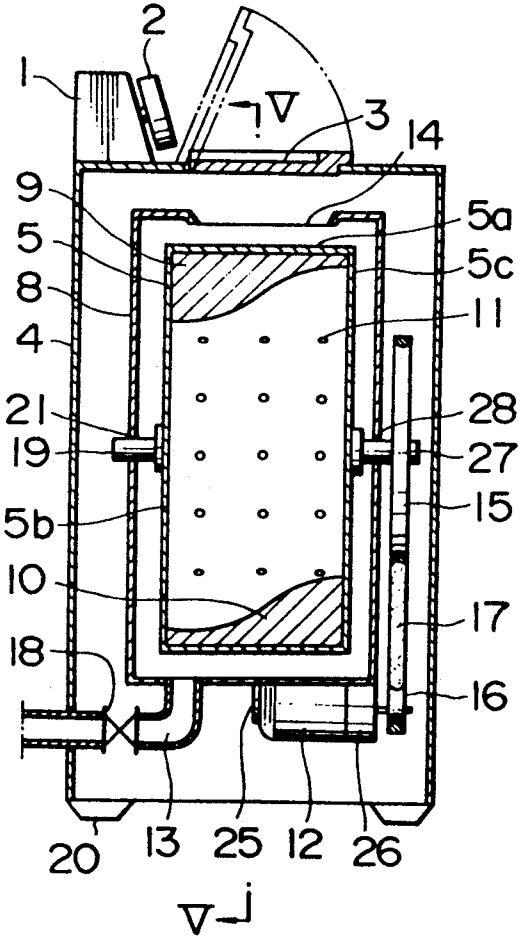
FIG. 4 is a vertical sectional view showing the conventional drum type washing machine.

In FIGS. 3(*a*)-3(*c*) are shown the various forms of the beaters to be installed on the peripheral wall 40. FIG. 3(*a*) shows the beater 43*a* in accordance with the present invention, whereas FIGS. 3(*b*) and 3(*c*) show beaters 43*b* and 43*c* installed for the purpose of comparison.

The beater 43*b* is a horizontal beater which has the form of an isosceles triangle of the apex angle $\theta$ with its base parallel to the axis of rotation, and the beater 43*c* is a ridge type beater whose plane is approximately a rhombic form with an apex projecting out toward the axis of rotation.

The drum 31 and the outer tank 32 are suspended on a spring 51 for preventing vibrations.

Reference numeral 45 is a balance weight attached to the upper part of the outer tank 32 which has a weight to balance the motor 37 installed on the lower part of the outer tank 32. As a result of the installation of the balance weight 45, the large-diameter part at the center of the drum 31 is disposed substantially at the central part of the spring 51 for elastically supporting the outer tank 32, whereby enabling to keep the position of the center of gravity.

Further, a feed water pipe 46 for feeding water for washing to the interior of the drum 31 is connected to the top surface of the outer tank 32, and a drainage pipe for draining water in the outer tank 32 by opening and closing a damper 48 in the midst of the washing process or in the dehydration process, is provided at the central lower part of the drum 31 of the outer tank 32.

The damper 48 is opened at the time of draining from the outer tank 32 to discharge the drain to a drainage ditch 49 on the outside of the machine.

The rotation speed of the motor 37 is adjusted by means of speed varying device 50, and the rotation speed of the motor 37 is controlled so as to rotate the drum 31 at respective optimum speeds in the washing and the dehydration processes.

The operation of the washing machine with the above construction will now been described next.

First, in the washing process, a predetermined quantity of water is fed from the feed water pipe 46 to the inside of the drum 31 and the outer tank 32. Since numerous holes 44 are provided in the peripheral wall 40 of the drum 31, water supplied to the interior of the drum 31 passes through the holes 44 and is collected in the interior of the outer tank 32, with the water level in the drum 31 rising gradually. Water feeding is stopped when the water level checked by a water level detector, which is not shown, reaches a predetermined level. When the water feeding is completed, the door 39 is opened and the laundry is supplied to the inside of the drum 31.

Then, the motor 37 is started, and the drum 31 is rotated at a predetermined speed. Repeating the rotation of the drum 31 in the forward and the reverse directions is effective in preventing the entanglement of the laundry 42. It should be noted that the optimum number of revolution corresponds normally to a rotation for which an acceleration of; 0.6 to 0.8G is obtainable on the inner wall of the drum 31.

A preliminary washing is carried out by supplying a detergent and an auxiliary to the drum 31 from a supply device of a detergent, an auxiliary and the like that is not shown. At the time when the preliminary washing is completed, wash water used for the preliminary washing is discharged to the drainage ditch 49 via the drainage pipe 47 by opening the damper 48, and the damper 48 is closed after the elapse of a predetermined time or by detecting the completion of draining of the water for the preliminary washing with a sensor that is not shown.

Next, washing water is fed again into the drum 31 to a predetermined level in the same way as in the above, and a detergent and an auxiliary are supplied into the drum 31 from a detergent and auxiliary supplying device which is not shown.

Here, steam is blown into water in the outer tank 32 by activating a steam nozzle which is not shown to raise the temperature of the water for washing to a predetermined level. The rotation of the drum 31 is controlled by means of the speed changing device 50 through control of the rotation speed of the motor 37. Soil on the laundry 42 is removed by the action of mechanical force or the like which is generated by the impact of the laundry 42 with the water surface when the laundry is lifted by the beaters 43 to the upper part of the drum 31 and is dropped from there. In this way, the laundry is washed in warm water, then the wash water absorbed in the laundry 42 is shaken off by centrifugal force by rotating the drum 31 at a medium speed. Naturally, in this case, the wash water is drained to the outside of the washing machine through the drainage pipe 47 by opening the damper 48.

Here, the washing effect of the three types of the beaters 43 shown in FIGS. 3(*a*), 3(*b*) and 3(*c*), namely, the trough type beater 43*a* with a plate shape whose upper sides form an angle $\theta'$ that is equal to or greater than the ridge angle $\theta$ of the drum 31, the parallel type beater 43*b* with a triangular shape whose base line is substantially parallel to the rotary shaft 33 and the ridge type beater 43*c* with a rhombic shape whose one apex projects into the direction opposite to that of the ridge angle $\theta$ of the drum 31, will be compared.

The result of a test on the washability and the balancing of the drum 31 for the beaters 43*a*, 43*b* and 43*c* is as shown in the following table which shows that the trough type beater 43*a* is the most effective.

TABLE

| Beater Form | Trough Type | Parallel Type | Ridge Type |
|---|---|---|---|
| Motion of the laundry within the drum | ○ | Δ | X |
| Balancing | ○ | X | X |

In other words, in the action of the beater 43 which, in the course of the washing process, lifts the laundry 42 to higher positions as the drum 31 rotates and allows the laundry 42 to fall normally at the location of 10 to 11 o'clock on the face of the clock (in the case of the rotation in the clockwise direction), the laundry 42 does not drop, but is carried with the rotation of the drum 31 if the height (H in FIG. 3) of the beater 43 is too large. For this reason, it becomes necessary to reduce the number of revolutions of the drum 31. In that case, the frequency of falls of the laundry 42 within the drum is diminished which becomes a factor for the deterioration in the cleaning power.

On the other hand, if the height of the beater is too small, the laundry 42 cannot be lifted to higher positions, and needless to say the washability is decreased to an extreme degree.

It can be said that what has been mentioned in the above is reflected faithfully in the table shown.

Hereafter, water contained in the laundry 42 is centrifugally removed in order to be prepared for the next process of rinsing. For the centrifugal dehydration at this time, it is necessary to select an appropriate number of revolutions of the drum 31 in order to uniformly distribute the laundry 42 in a well-balanced manner. The number of revolutions for this purposes corresponds normally to a rotation for which an acceleration of 1.0 to 1.5G is obtainable on the inner wall of the drum 31. During the rotation, if the height of the beater 43 is too large, the laundry 42 will not be distributed in a well-balanced manner between the neighboring beaters 43 so that the drum 31 is brought to a condition of eccentric load which leads to extremely large rotational vibrations. Thus, it becomes necessary to temporarily stop the operation of the machine for the reason of the safety, and to redistribute the laundry 42 in a well-balanced manner.

It can also be said that the ridge type beater 43*a* adopted in the present invention is preferable as the form of the beater 43. And it is found as the result of a test that the adequate height of the beater 43*a* is 8 to 14% of the drum diameter.

Following dehydration of dirty water after the washing, clean water is fed again into the drum 31 by closing the damper 48 to carry out the rinsing process. The rinsing process can be performed in the same way as for the washing process. When the rinsing process in which feeding and draining of rinsing water are repeated, it proceeds to the dehydration process.

In the dehydration process, the drum 31 is rotated at a speed to produce an acceleration of 1.0 to 1.5G on the inner circumference of the drum by the control that uses, the speed varying device 50. This is for distributing the laundry 42 nearly uniformly over the inner circumferential surface of the drum 31 as mentioned earlier. After a state is reached in which the laundry 42 is distributed uniformly over the inner circumferential surface of the drum 31, the drum 31 is rotated at a high speed to drain the water attached to the laundry 42 through the holes 44 of the drum 31 by centrifugal force. The water flows from the outer tank 32 through the drainage pipe 47 into the drainage ditch 49.

It is to be mentioned here that the result of a test done by varying the ridge angle $\theta$ of the drum 31 is the same as was disclosed in Japanese Patent Application No. 63-40513 proposed by the present inventors. It is known that the optimum angle for 8 is 90 to 160°, and the preferable practical value is 120 to 150°.

By adopting the drum shape and the beater form of the present invention described in the above, during the washing process, it becomes possible to operate the machine so as to constantly gather the laundry to the central part of the drum and to increase the number of times of dropping the laundry within the drum, so that the effect on the enhancement of the washability is remarkable. Further, in the dehydration process, by properly adjusting the form and height of the beater, it becomes easy to balance the drum. And by adopting the abacus bead type drum and an adequate height of the beater, it becomes possible to concentrate the load on the portion of the center of gravity by easily gathering the laundry at the central part of the drum, thereby enabling an operation of the machine which is accompanied by an extremely small degree of vibrations.

Moreover, in the washing machine according to the present invention the drum can be supported in cantilever style so that the bringing in and the taking out of the laundry becomes easy which enhances the operability of the machine.

What I claim is:

1. In a drum type washing machine which has a rotary drum with a plurality of water-passing holes in its peripheral wall installed within an outer tank, and executes washing, dehydration and drying of laundry within the drum individually or consecutively while driving the drum to be rotated, the drum type washing machine characterized in that said drum is formed by said peripheral wall with the form obtained by interfacing the edges of the large-diameter parts of two truncated cones of substantially the same form, having a rotary shaft that is held substantially horizontally at the center of one of its end walls, and said drum is equipped with a plurality of platelike beaters that are arranged on the inner surface of said peripheral wall with a predetermined spacing in the circumferential direction of said drum to extend centripetally over the entire length of the drum from said peripheral wall in the direction of the axis of rotation of said rotary shaft, wherein said peripheral wall of said drum and each of said beaters have a V shape in cross-section containing the axis of rotation of said rotary shaft with each of said beaters having a radially inner side formed with an inner angle of V shape, wherein said drum is supported in cantilever style by said rotary shaft that is provided on one of the end walls of the drum, and has in the other end wall an opening for inserting and removing the laundry, wherein the magnitude of said inner angle of V shape of each of said beaters is set to equal the magnitude of said inner angle of V shape of said peripheral wall, said inner angle of V shape for said peripheral wall being set in the range of 90 to 160°, and wherein the height of each of said beaters is in the range of 8 to 14% of the maximum diameter of said drum.

2. In a drum type washing machine which has a rotary drum with a plurality of water-passing holes in its peripheral wall installed within an outer tank, and executes washing, dehydration and drying of laundry within the drum individually or consecutively while driving the drum to be rotated, the drum type washing machine characterized in that said drum is formed by said peripheral wall with the form obtained by interfacing the edges of the large-diameter parts of two truncated cones of substantially the same form, having a rotary shaft that is held substantially horizontally at the center of one of its end walls, and said drum is equipped with a plurality of platelike beaters that are arranged on the inner surface of said peripheral wall with a predetermined spacing in the circumferential direction of said drum to extend centripetally over the entire length of the drum from said peripheral wall in the direction of the axis of rotation of said rotary shaft, wherein said peripheral wall of said drum and each of said beaters have a V shape in cross-section containing the axis of rotation of said rotary shaft with each of said beaters having a radially inner side formed with an inner angle of V shape, wherein said drum is supported in cantilever style by said rotary shaft that is provided on one of the end walls of the drum, and has in the other end wall an opening for inserting and removing the laundry, and wherein the magnitude of said inner angle of V shape of each of said beaters is st to equal the magnitude of said inner angle of V shape of said peripheral wall, said inner angle of V shape of said peripheral wall being set in the range of 120 to 150°.

3. In a drum type washing machine which has a rotary drum with a plurality of water-passing holes in its peripheral wall installed within an outer tank, and executes washing, dehydration and drying of laundry within the drum individually or consecutively while driving the drum to be rotated, the drum type washing machine characterized in that said drum is formed by said peripheral wall with the form obtained by interfacing the edges of the large-diameter parts of two truncated cones of substantially the same form, having a rotary shaft that is held substantially horizontally at the center of one of its end walls, and said drum is equipped with a plurality of platelike beaters that are arranged on the inner surface of said peripheral wall with a predetermined spacing in the circumferential direction of said drum to extend centripetally over the entire length of the drum from said peripheral wall in the direction of the axis of rotation of said rotary shaft, wherein said peripheral wall of said drum and each of said beaters have a V shape in cross-section containing the axis of rotation of said rotary shaft with each of said beaters having a radially inner side formed with an inner angle of V shape, wherein said drum is supported in cantilever style by said rotary shaft that is provided on one of the end walls of the drum, and has in the other end wall an opening for inserting and removing the laundry, wherein the magnitude of said inner angle of V shape of each of said beaters is set to equal the magnitude of said inner angle of V shape of said peripheral wall, and wherein the height of each of said beaters is in the range of 8 to 14% of the maximum diameter of said drum.

4. The drum type washing machine as claimed in claim 2, wherein the height of each of said beaters is in the range of 8 to 14% of the maximum diameter of said drum.

* * * * *